US007527003B1

(12) United States Patent
Schorr et al.

(10) Patent No.: US 7,527,003 B1
(45) Date of Patent: May 5, 2009

(54) RAILROAD FREIGHT CAR SIDEBEARING

(75) Inventors: Ralph H. Schorr, Edwardsville, IL (US); Bradford Johnstone, Plainfield, IL (US)

(73) Assignee: ASF Keystone, Inc., Granite City, IL (US)

( * ) Notice: Subject to any disclaimer, the term of this patent is extended or adjusted under 35 U.S.C. 154(b) by 0 days.

(21) Appl. No.: 12/154,103

(22) Filed: May 21, 2008

(51) Int. Cl.
*B61F 3/00* (2006.01)
*B61F 1/00* (2006.01)
*F16C 17/04* (2006.01)

(52) U.S. Cl. ..... 105/199.3; 105/453; 384/423

(58) Field of Classification Search ..... 105/199.3, 105/199.4, 453; 384/423
See application file for complete search history.

(56) References Cited

U.S. PATENT DOCUMENTS 2,250,134 A * 7/1941 Pointer ..... 280/439
2,756,691 A * 7/1956 Masel et al. ..... 105/185
3,730,104 A * 5/1973 Hood, II ..... 105/199.3
6,092,470 A * 7/2000 O'Donnell ..... 105/199.3
6,581,527 B2 * 6/2003 Hewitt ..... 105/199.3
6,644,214 B1 * 11/2003 Schorr ..... 105/199.3
7,121,212 B2 * 10/2006 Schorr et al. ..... 105/199.3
7,338,034 B2 * 3/2008 Aspengren et al. ..... 267/3
2004/0187726 A1 * 9/2004 Schorr et al. ..... 105/199.3
2004/0261652 A1 * 12/2004 Berg et al. ..... 105/182.1
2005/0087092 A1 * 4/2005 McKisic et al. ..... 105/199.3
2006/0042498 A1 * 3/2006 Schorr et al. ..... 105/199.3
2008/0035012 A1 * 2/2008 Monaco et al. ..... 105/199.3
2008/0035013 A1 * 2/2008 Johnstone et al. ..... 105/199.3
2008/0115690 A1 * 5/2008 Mitchell et al. ..... 105/199.3
2008/0141896 A1 * 6/2008 O'Donnell et al. ..... 105/199.3
2008/0173211 A1 * 7/2008 Kennedy ..... 105/199.3

* cited by examiner

*Primary Examiner*—S. Joseph Morano
*Assistant Examiner*—Jason C Smith
(74) *Attorney, Agent, or Firm*—Edward J. Brosius

(57) ABSTRACT

An improved side bearing for railway cars is provided that achieves improved tracking and curving by the limitation of rock of the railway car. The side bearing comprises a base with a generally upwardly extending wall portion. A cap comprising a top section with generally downwardly extending wall portion is provided. The cap extends into or around the wall section of the base. Two coil springs are provided within the base that extend to the underside and support the cap. An elastomer spring is also provided that is located within an least of one of the coil springs.

22 Claims, 4 Drawing Sheets

RAILROAD FREIGHT CAR SIDEBEARING

BACKGROUND OF THE INVENTION

The present invention relates to an improved side bearing for mounting on a railway car truck bolster that provides improved control to limit rock and roll characteristics of the railway car in service.

In a typical railway freight train, such as shown in FIG. 1, railway cars 212, 214 are connected end to end by couplers 216, 218. Couplers 216, 218 are each received in draft sills 220, 222 of each respective car along with cushioning or draft gear assemblies not shown. Draft sills 220, 222 are provided at the end of the railway car center sill, and include center plates that rest in center plate bowls of railway car trucks 226, 228.

As is better shown in FIG. 2, each typical car truck 226 includes a pair of side frames 230, 232 supported on axle-wheel sets 234, 236. Bolster 238 extends between and is supported on springs 240 mounted on side frames 230, 232. Bolster center plate 224 includes a central opening 242. Side bearing pads 260 are provided laterally to each side of the center plate 224 on bolster 238. Side frames 230, 232 comprise a top member 244, compression member 246, tension member 248, column 250, pedestal 254, pedestal roof 256, wheel axle bearings 258, and bearing adapter 262. Side bearings are commonly used on railroad car trucks. Such side bearings are typically located on the truck bolster such as on side bearing pads 260, but may be located elsewhere on the bolster.

Typical side bearing arrangements are designed to control hunting of the railroad car. As a railroad car travels along the railroad track, a yaw excess motion can be induced in the railroad car truck. As the truck yaws, part of the side bearing is made to slide across the underside of a wear plate bolted to the railroad car body bolster. The resulting friction produces an opposing torque that acts to prevent such yaw motion. Another purpose of railroad car truck side bearings is control or limit the rock or roll motion of the car body. Most prior side bearing designs limited vertical travel of the side bearings. The maximum vertical travel of side bearings is specified in the Association of American Railroad Standards.

Accordingly, it is an object of the present invention to provide an improved side bearing which will limit the vertical rock or roll motion of the railway freight car.

It is another object of the present invention to provide an improved side bearing which will provide improved control over the rock or roll motion of an empty railway freight car.

SUMMARY OF THE INVENTION

A side bearing is provided with improved characteristics to enhance the performance of rail cars, especially in unloaded conditions.

One embodiment of a side bearing in accordance with the present invention includes a base having a bottom portion and a base wall structure extending generally upwards therefrom. The base wall structure forms a base receiving structure with a generally open centrally located top. The dual rate spring assembly is positioned in the base receiving structure. A first coil spring is positioned within a second coil spring and an elastomer spring. The second coil spring has a larger diameter and is located adjacent the inner surface the base wall structure. The first and second coil springs each have a preselected non-compressed height.

An elastomer spring of a generally cylindrical rod shape is positioned within the first coil spring. The elastomer spring has a non-compressed height that is less than the non-compressed height of the second coil spring, and in certain embodiments of the present invention, of a lesser height than the first coil spring.

A cap that is of a generally inverted cup structure has a top portion and a cap wall structure extending generally downward from the top portion. The cap wall structure forms the cap receiving structure having an open bottom.

The top portions of the first coil spring and the second coil spring extend into the cap receiving structure open bottom to support the cap.

The base is usually a unitary cast steel or cast iron structure, but could be fabricated. The cap structure is also usually a generally cast steel or cast iron unitary structure, but also in certain embodiments could be fabricated.

The first and second coil springs are typical steel coil springs. The elastomer spring is usually formed of a urethane polymer, or other suitable elastomer.

In another embodiment, a side bearing for use in a railway car truck is provided comprising a base having a bottom portion and a base wall structure extending generally upward therefrom. The base wall structure forms a receiving structure having an open top.

A first coil spring having a preselected non-compressed height is positioned in the base receiving structure. An elastomer spring of a generally cylindrical shape having a preselected non-compressed height less than the height of the first coil spring, is positioned within the first coil spring. A second coil spring having a preselected non-compressed height is positioned within the central opening of the cylindrical elastomer spring.

A cap having a top portion and a cap wall structure extending generally downward from the top portion is provided, with the cap wall structure forming a cap receiving structure having an open bottom. The top portions of the first coil spring and the second coil spring extend into the cap receiving structure open bottom to support the cap.

The base is usually a cast steel or cast iron unitary component, but could be a fabricated structure. The cap is also usually a cast steel or cast iron unitary component, but also could be fabricated. The coil springs are typical steel coil springs. The elastomer spring is usually formed of a urethane polymer.

In both embodiments, at the standard set-up height of 5 1/16 inches, the cap will not contact the elastomer spring under normal operating conditions for an empty or loaded railway car. The coil springs accordingly will support the cap and thusly the railway freight car bolster which extends across and above the railway truck bolster and has a lower structural portion that contacts the top of the side bearing cap. In a rock condition due to curving or other forces that the freight car is being subjected to, the appropriate side bearing coil springs will be compressed until the cap contacts the elastomer spring. Such elastomer spring will limit the rock of the railway freight car as the elastomer will have a selected load rating to increase the spring stiffness during further travel downward into or over the base of the side bearing. By limiting such downward travel of the cap, the rock of the railway freight car, especially in an unloaded condition, is kept within preselected design parameters.

DETAILED DESCRIPTION OF THE PREFERRED EMBODIMENT

Figure 1:
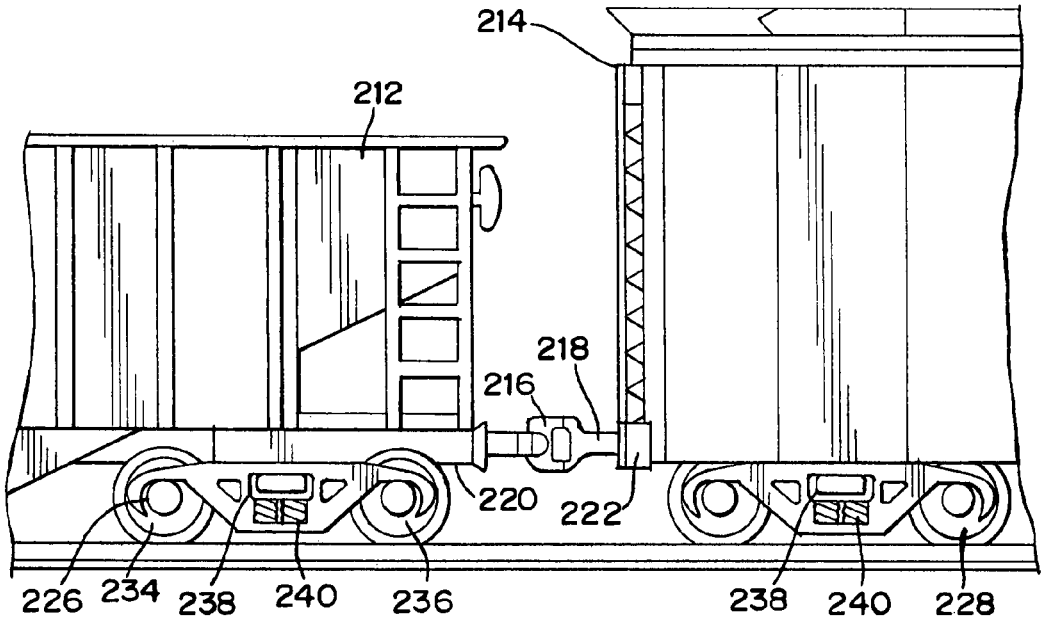
FIG. 1 is a partial schematic of coupled ends of typical railway freight cars.
Figure 2:
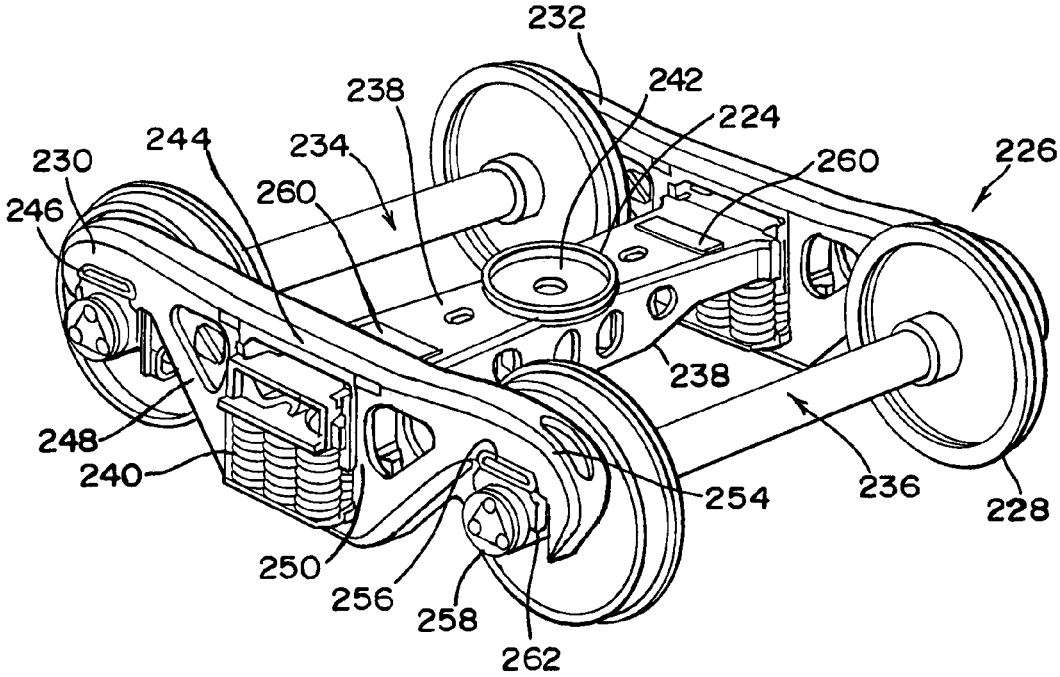
FIG. 2 is a perspective view of a typical railway car truck.
Figure 3:
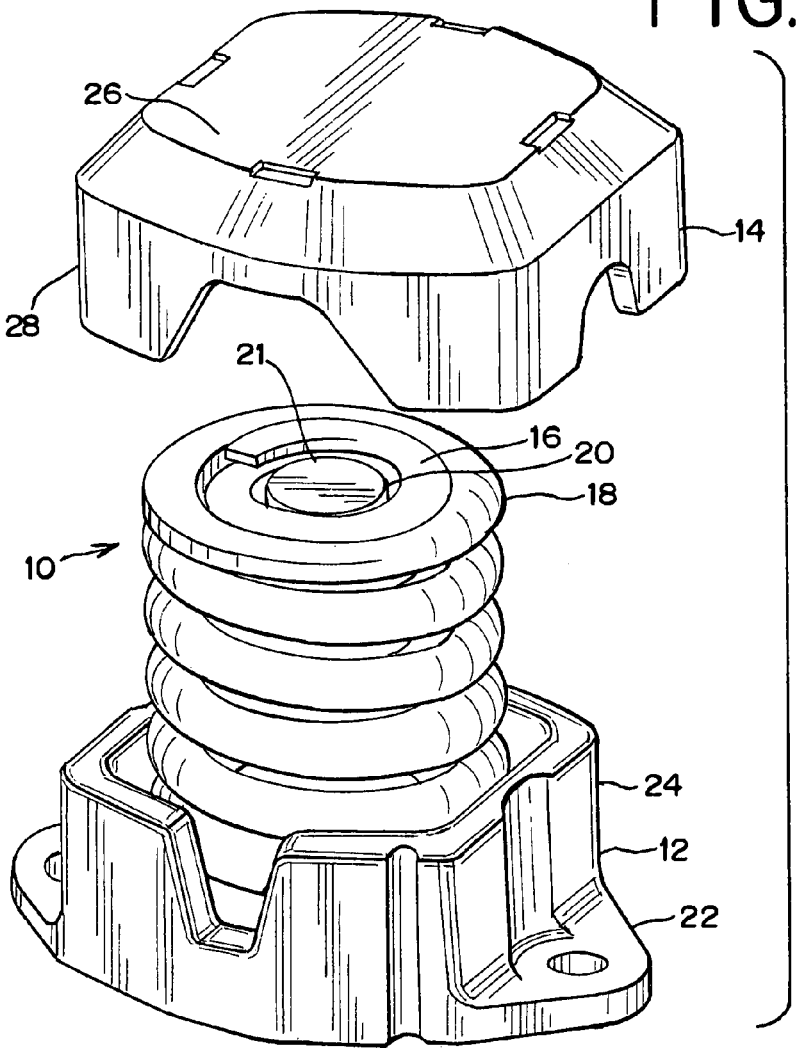
FIG. 3 is an exploded perspective view of one embodiment of a side bearing according to the present invention.
Figure 4:
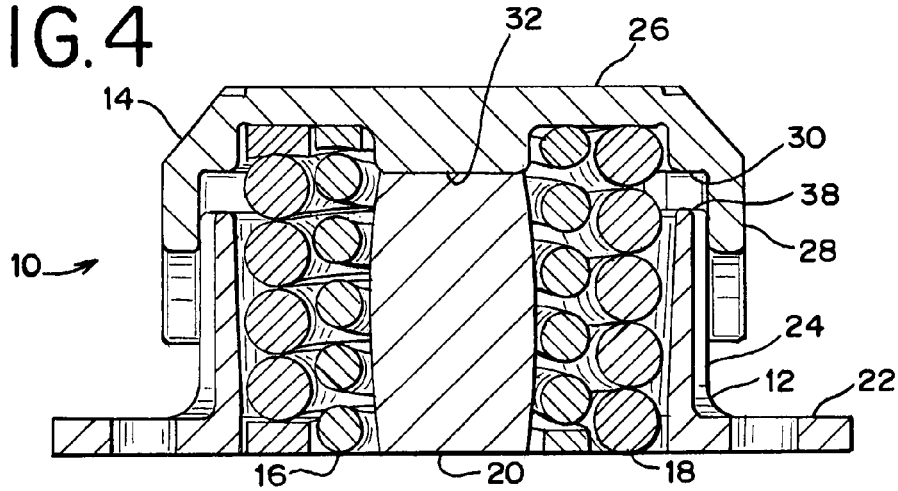
FIG. 4 is a cross sectional view of the first embodiment of the side bearing.

Referring now to FIGS. 3 and 4, a first embodiment of the side bearing according to the present invention is shown. Side bearing 10 includes a base structure 12, which is comprised of a bottom portion 22 and a base wall 24 extending generally vertically upward therefrom. Base 12 is usually cast steel or cast iron unitary structure, but can be fabricated or machined as well. The shape of base 22 can be circular, somewhat rectangular, or somewhat oval or diamond shaped as the use dictates.

Cap 14 is seen to be comprised of a top portion 26 with a wall structure 28 extending generally downward from the outer edge of cap 14. Again, cap 14 is usually a cast steel or cast iron unitary structure, but can be fabricated or machined as well.

Base 12 is seen to also include a base wall top stop surface 38 which is located at the top of base wall 24. Similarly, cap 14 is seen to include a cap inner stop surface 30 which is formed by an inner surface within cap 14 and is adjacent and complementary to base wall top stop surface 38. An elastomer spring 20 is seen to be formed in a generally cylindrical rod structure, with a bottom supported on side bearing pad 260 of bolster 238. A first coil spring 16 is located outwardly from elastomer spring 20. A second coil spring 18 is located radially outward from first coil spring 16. Second coil spring 18 accordingly is adjacent the inner surface of base wall 24. Cap inner center projection 32 is adjacent a top portion 21 of elastomer spring 20 as depicted in FIG. 4. First coil spring 16 and second coil spring 18 would be compressed by the downward travel of cap 14 to the point that cap inner center projection 32 would contact elastomer spring 20. Such contact could occur in an unloaded car condition under a rock condition of railway freight cars 212 or 214. Such contact with cap inner center projection 32 and top 21 of elastomer spring 20 would limit the rock of the railway freight car 212 or 214.

It should be understood that under normal operation of railway freight cars 212 and 214 in an unloaded condition, cap inner center projection 32 will not contact top 21 of elastomer spring 20. Accordingly, under normal operation of railway 212 and 214, cap 14 would be supported by first coil spring 16 and second coil spring 18.

First coil spring 16 would be of a typical length of about 5.63 inches with a load rating of about 1500 lb/in. Second coil spring 18 would be of a typical length of about 5.78 inches and a load rating of about 2500 lb/in. Such coil springs are typically steel coil springs that are readily available from suppliers such as ASF-Keystone, Inc.

Elastomer spring 20 is a typical polymer elastomer available from companies such as the Pennsy Corporation, and is seen to be comprised of a circular rod structure. Of course other cross sectional structures of elastomer spring 20 would be operable in this embodiment such as squares or multiple edges such as octagons, but as elastomer spring 20 is located within first coil spring 16, a cylindrical rod structure would be preferred.

Figure 4A:
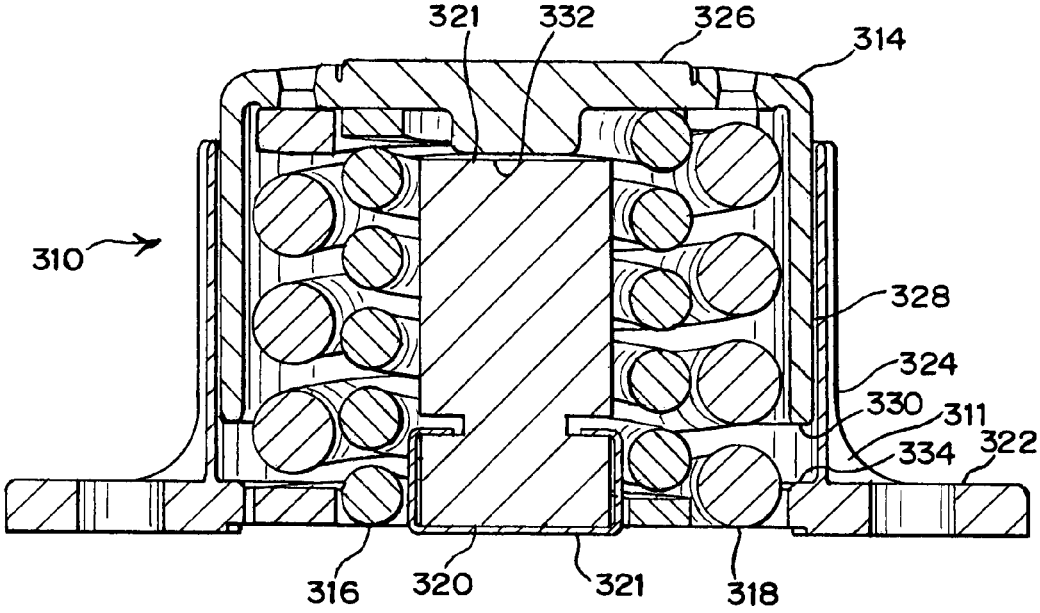
FIG. 4A is a cross sectional view of a second embodiment of the side bearing.

Referring now to FIG. 4A, a second embodiment of the side bearing according to the present invention is shown. Side bearing 310 includes a base structure 311, which is comprised of a bottom portion 322 and a base wall 324 extending generally vertically upward therefrom. Base 311 is usually a cast steel or cast iron unitary structure, but can be fabricated or machined as well. The shape of base 322 can be circular, somewhat rectangular, or somewhat oval or diamond shaped as the use dictates.

Cap 314 is seen to be comprised of a top portion 326 with a wall structure 328 extending generally downward from the outer edge of cap 314. Again, cap 314 is usually a cast steel or cast iron structure, but can be fabricated or machined as well. Cap includes a lower edge 330.

Base bottom portion 322 is seen to also include a base inner surface 334 which is located inward of base wall 324.

Cap 314 extends downwardly and inwardly inside base wall 324 until cap wall lower edge 330 contacts base inner surface 334. An elastomer spring 320 is seen to be formed in a generally cylindrical rod structure, with a bottom portion supported on side bearing pad 260 of bolster 238. Elastomer spring support 321 is typically a metal cup like structure that supports elastomer spring 320. A first coil spring 316 is located outwardly from elastomer spring 320. A second coil spring 318 is located radially outward from first coil spring 316. Second coil spring 318 accordingly is adjacent the inner surface of cap wall 328. Cap inner center projection 332 is adjacent a top portion 321 of elastomer spring 320 as depicted in FIG. 4A. First coil spring 316 and second coil spring 318 would be compressed by the downward travel of cap 314 to the point that cap inner center projection 332 would contact elastomer spring 320. Such contact could occur in an unloaded car condition under a rock condition or railway freight cars 212 or 214. Such contact with cap inner center projection 332 and top 321 of elastomer spring 320 would limit the rock of the railway freight car 212 and 214.

It should be understood that under normal operation of railway freight cars 212 and 214 in an unloaded condition, cap inner center projection 32 will not contact top 21 of elastomer spring 20. Accordingly, under normal operation of railway cars 212 and 214, cap 14 would be supported by first coil spring 216 and second coil spring 318.

First coil spring 316 would be of a typical length of about 5.63 inches with a load rating of about 1500 lb/in. Second coil spring 318 would be of a typical length of about 5.78 inches and a load rating of about 2500 lb/in. Such coil springs are typically steel coil springs that are readily available from suppliers such as ASF-Keystone, Inc.

Elastomer spring 320 is a typical polymer elastomer available from companies such as Pennsy Corporation, and is seen to be comprised of a circular rod structure. Of course other cross sectional structures of elastomer spring 320 would be operable in this embodiment such as squares or multiple edges such as octagons, but as elastomer spring 320 is located within the first coil spring 316, a cylindrical rod structure would be preferred.

Figure 6A:
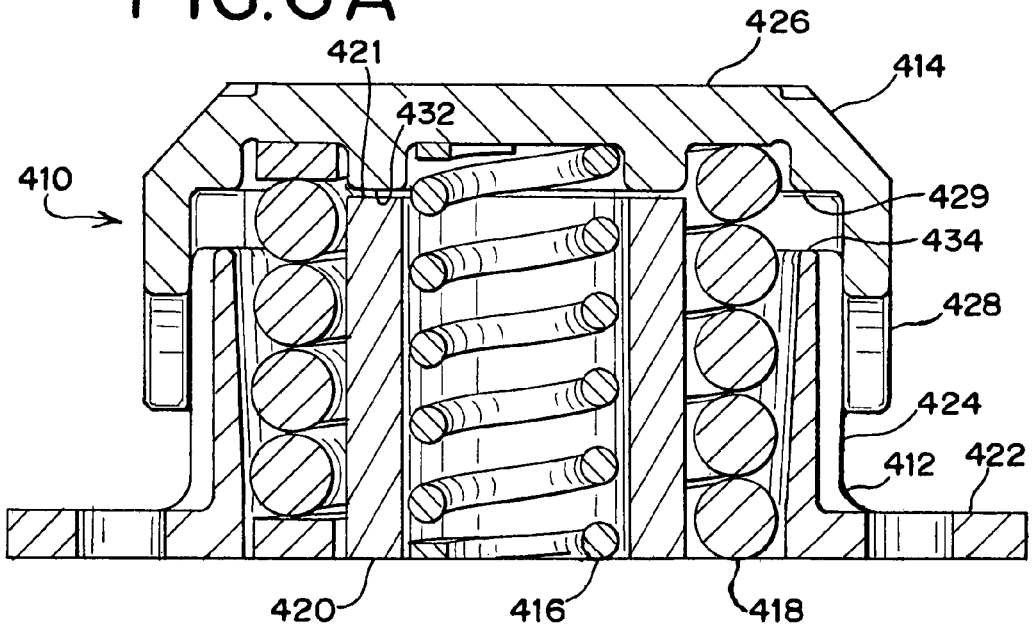
FIG. 6A is a side cross sectional view of a fourth embodiment of a side bearing.
Figure 5:
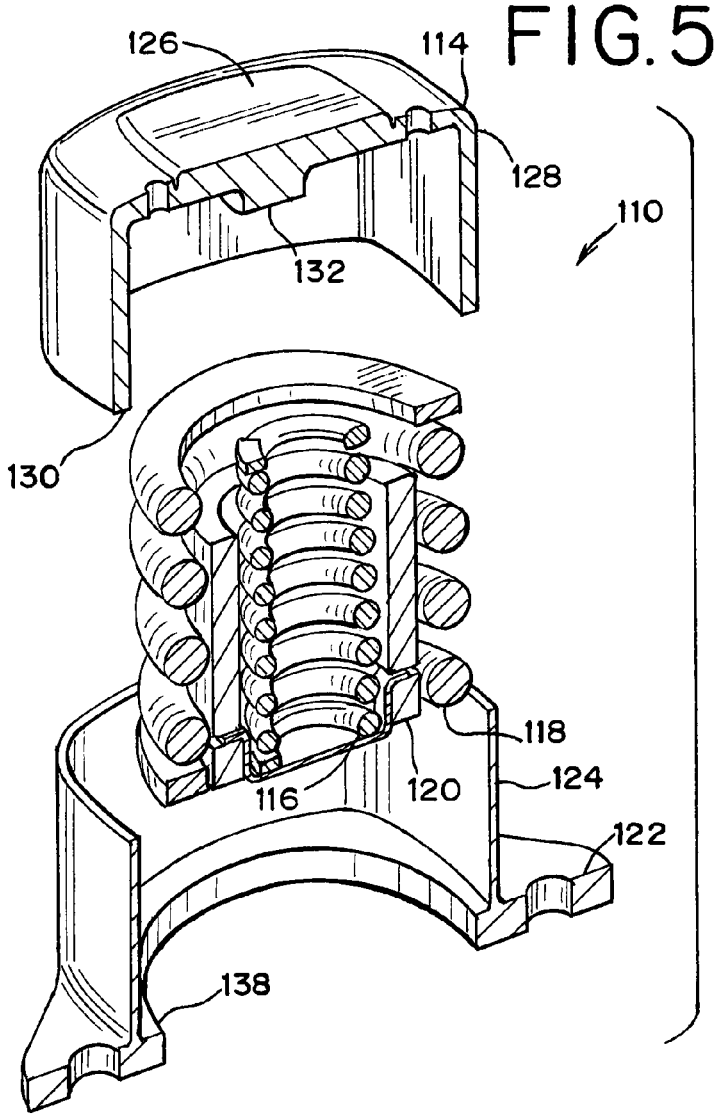
FIG. 5 is an exploded view of a third embodiment of a side bearing.
Figure 6:
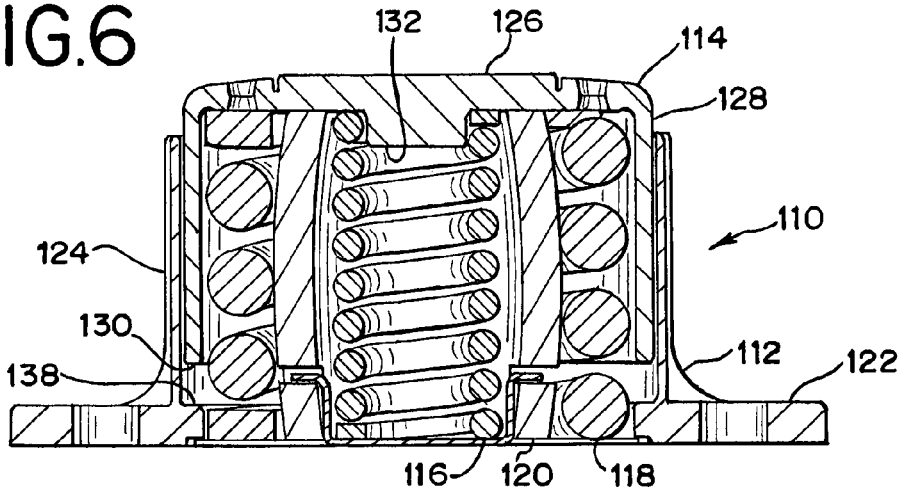
FIG. 6 is a side cross sectional view of the third embodiment of a side bearing.

Referring now to FIGS. 5 and 6, a third embodiment of the present invention is shown. Side bearing 110 is seen to be comprised of base 112, which includes base bottom portion 122 and base wall structure 124 extending generally upward therefrom. Base 112 is usually a cast steel or cast iron unitary steel structure but could be fabricated or machined as well. Base 112 is seen to also comprise a base top stop surface 138 which is adjacent and inner surface of base wall 124.

Cap 114 is seen to be comprised of a top portion 126, which has a cap inner center projection 132 extending downwardly from a center portion thereof. Cap 114 also includes cap wall 128 extending generally downward from the outer edge of cap 114. Cap 114 is usually cast steel or iron but could be fabricated or machined as well.

Cap 114 wall 128 is seen to extend inward into base 112. Cap inner stop surface 130 is located at the lower edge of cap wall 128. Cap inner stop surface 130 is seen to limit the downward travel of cap 114 by contacting base top stop surface 138. Although cap 114 is seen to travel downwardly with cap wall 128 extending into an open structure formed by base wall 124, it is conceivable that in another embodiment of the present invention cap wall 128 could extend outward of base wall 124.

A first coil spring 116 is seen to extend upwardly from cup shaped spring support 121 which itself is generally a steel structure. A top portion of first coil spring 116 is seen to extend upwardly to support the bottom inner surface of cap top 126. Cap inner center projection 132 is seen to extend into a top opening of first coil spring 116. An elastomer spring 120 is seen to be comprised of generally cylindrical open structure that is located radially outward from first coil spring 116. Another way of describing this arrangement is to state that first coil spring 116 is located within the central opening of cylindrical elastomer spring 120. The top of elastomer spring 123 contacts the underside of the cap 131 under a rock condition of railway freight cars 212 or 2A.

A second coil spring 118 is seen to be located outwardly of elastomer spring 120. Another way of describing this arrangement is to say that second coil spring 118 is located radially within both base wall structure 124 and cap wall structure 128.

First coil spring 116 and second coil spring 118 are typical steel coil springs available suppliers from such as ASF-Keystone, Inc. The typical length of first coil spring 116 is about 5.63 inches with a typical load rating of about 805 lb/in. A typical length of second coil spring 118 is about 5.65 inches with a typical load rating of about 2500 lb/in.

Elastomer spring 120 is typically comprised of an elastomer polymer and is available from the Pennsy Corporation.

It should be understood that under normal operation of railway freight cars 212 and 214 in an empty or loaded condition, cap inner surface 131 will not contact top 123 of elastomer spring 120. Accordingly, under normal operation of railway 212 and 214, cap 114 would be supported by first coil spring 116 and second coil spring 118.

Referring now to FIG. 6A, a fourth embodiment of the present invention is shown. Side bearing 410 is seen to be comprised of base 412, which includes base bottom portion 422 and base wall structure 424 extending generally upward therefrom. Base 412 is usually a cast steel or cast iron unitary steel structure but could be fabricated or machined as well. Base wall 424 is seen to also comprise a base top stop surface 434.

Cap 414 is seen to be comprised of a top portion 426, which has a cap inner center projection 432 extending downwardly from a center portion thereof. Cap 414 also includes cap wall 428 extending generally downward from the outer edge of cap 414. Cap 414 is usually cast steel or iron but could be fabricated or machined as well.

Cap 414 wall 428 is seen to extend outwardly over base wall structure 424. Cap inner stop surface 429 is located at an inner upper edge of cap wall 428. Cap inner stop surface 429 is seen to limit the downward travel of cap 414 by contacting base wall top stop surface 434. Although cap 414 is seen to travel downwardly with cap wall 428 extending over base wall 424, it is conceivable that in another embodiment of the present invention cap wall 428 could extend inward of base wall 424.

A first coil spring 416 is seen to extend upwardly from support on bolster side bearing end 260. A top portion of first coil spring 416 is seen to extend upwardly to support the bottom inner surface of cap top 426. Cap inner center projection 432 is seen to extend between first coil spring 416 and second coil spring 418 and adjacent the top of elastomer spring 420.

An elastomer spring 420 is seen to be comprised of generally cylindrical open structure that is located radially outward from first coil spring 416. Another way of describing this arrangement is to state that first coil spring 416 is located within the central opening of cylindrical elastomer spring 420. The top of elastomer spring 420 contacts cap inner projection 432 under a rock condition of railway freight cars 212 or 2A.

A second coil spring 418 is seen to be located outwardly of elastomer spring 420. Another way of describing this arrangement is to say that second coil spring 418 is located radially within both base wall structure 424 and cap wall structure 428.

First coil spring 416 and second coil spring 418 are typical steel coil springs available suppliers from such as ASF-Keystone, Inc. The typical length of first coil spring 416 is about 5.63 inches with a typical load rating of about 805 lb/in. A typical length of second coil spring 418 is about 5.65 inches with a typical load rating of about 2500 lb/in.

Elastomer spring 420 is typically comprised of an elastomer polymer and is available from the Pennsy Corporation.

It should be understood that under normal operation of railway freight cars 212 and 214 in an empty or loaded condition, cap inner projection 433 will not contact the top of elastomer spring 421. Accordingly, under normal operation of railway cars 212 and 214, cap 414 would be supported by first coil spring 416 and second coil spring 418.

What is claimed is:

1. A side bearing for use in a railway car truck the side bearing comprising:

a base having a bottom portion and a base wall structure extending generally upward from the bottom portion, the base wall structure forming a base receiving structure having an open top, a dual spring assembly positioned in the base receiving structure of the base section, the dual spring assembly comprising a first coil spring positioned within a second coil spring, the first and second coil springs each having a preselected spring, non-compressed height, an elastomer spring of a generally cylindrical rod shape positioned within the first coil spring, the elastomer spring having a non-compressed height less than the non-compressed height of the first coil spring and the second coil spring, a cap having a top portion and a cap wall structure extending generally downward from the top portion, the cap wall structure forming a cap receiving structure having an open bottom, a portion of the first coil spring and a portion of the second coil spring extending into the cap receiving structure open bottom to support the cap.

2. The side bearing of claim 1 wherein the first coil spring and the second coil spring are of preselected non-compressed heights, and load ratings and the elastomer spring is of a preselected non-compressed height such that, under empty railway car conditions, the cap does not contact the elastomer spring under normal ride conditions.

3. The side bearing of claim 2 wherein the non-compressed height of the elastomer spring is about 0.06 inch less than the normal height of the inner center projection of the cap.

4. The side bearing of claim 1 wherein the first coil spring has a load rating of about 1500 lb/in and the second coil spring has load rating of about 2500 lb/in and the elastomer spring has a load rating of 5000 to 9000 lb/in.

5. The side bearing of claim 1 wherein the first coil spring and the second coil spring are of preselected non-compressed heights and the elastomeric spring is of a preselected height such that, under empty railway car conditions, the cap will contact the elastomeric spring when the railway car reaches a desired degree of rock from the vertical.

6. The side bearing of claim 1 wherein the base wall structure extends within the cap receiving structure, and wherein the base wall structure includes a top surface, and the cap wall structure includes a stop surface, and the base wall structure extension with the cap receiving structure is limited by the base wall structure top surface contacting the cap wall structure stop surface.

7. The side bearing of claim 1 wherein the first coil spring and the second coil spring have preselected non-compressed heights and load ratings, and the elastomeric spring has a preselected non-compressed height such that the cap will engage the elastomer spring only when the first and second coil springs are compressed to within about one half inch before the cap and base stop surfaces contact.

8. The side bearing of claim 1, wherein the cap wall structure extends within the base wall structure, and wherein the base bottom portion includes a inner surface, and the cap wall structure includes a bottom edge, and the cap wall structure bottom edge contacts the base bottom portion inner surface to limit the extrusion of the cap wall structure into the base wall structure.

9. A side bearing for use in a railway car truck, the side bearing comprising:

a base having a bottom portion and a base wall structure extending generally upward from the bottom portion, the base wall structure forming a base receiving structure having an open top, a dual spring assembly positioned in the receiving structure of the base section, the dual spring assembly comprising a first coil spring and a second coil spring, the first coil spring positioned within the second coil spring the first coil spring having a preselected non-compressed height, and the second coil spring having a preselected non-compressed height, an elastomer spring of a generally cylindrical rod like shape positioned within the first coil spring, the elastomer spring having a non-compressed height less than the non-compressed height of the second coil spring, and a cap having a top portion and a cap wall structure extending generally downward from the top portion, the cap wall structure having an open bottom, a portion of the first coil spring and a portion of the second coil spring extending into the cap receiving structure open bottom to support the cap.

10. The side bearing of claim 9 wherein the first coil spring has a preselected non-compressed height and a preselected load rating and the second coil spring has preselected non-compressed height and a preselected load rating, and the elastomer spring is of a preselected height such that, under empty railway car conditions, the cap does not contact the elastomer spring under normal ride conditions.

11. The side bearing of claim 9 wherein the first coil spring has a preselected non-compressed height and load rating, and the second coil spring has a preselected non-compressed height and load rating, and the elastomeric spring has a preselected height such that, under empty railway car conditions, the cap will contact the elastomeric spring when the railway car reaches a desired angle of rock from the vertical.

12. A side bearing for use in a railway car truck, the side bearing comprising:

a base having a bottom portion and a base wall structure extending generally upward from the bottom portion, the base wall structure forming a base receiving structure having an open top, a first coil spring having a preselected non-compressed height and positioned in the base receiving structure, and elastomer spring of a generally cylindrical shape and having a preselected non-compressed height, the elastomer spring positioned within the first coil spring, and the preselected non-compressed height of the elastomer spring being less than the preselected non-compressed height of the first coil spring, a second coil spring having a preselected non-compressed height and positioned within the elastomer spring, a cap having a top portion and a cap wall structure extending generally downward from the top portion, the cap wall structure forming a cap receiving structure having an open bottom, the first coil spring and the second coil spring extending into the cap receiving structure open bottom to support the cap.

13. The side bearing of claim 12 wherein the first coil spring has a preselected non-compressed height and a load rating, and the second coil spring has a preselected non-compressed height and a load rating, and the elastomer spring has a preselected height such that, under empty car conditions, the cap does not contact the elastomer spring under normal ride conditions.

14. The side bearing of claim 12 wherein the non-compressed height of the elastomer spring is about 0.06 inch less than the normal height of the cap projection.

15. The side bearing of claim 12 wherein the first coil spring has a load rating of about 2500 lb/in and the second coil spring has a load rating of 500 to 800 lb/in and the elastomer spring has a load rating of 5000 to 9000 lb/in.

16. The side bearing of claim 12 wherein the first coil spring and the second coil spring are of preselected non-compressed heights, and the elastomeric spring is of a preselected height such that, under empty railway car conditions, the cap will contact the elastomeric spring when the railway car reaches a desired degree of rock from the vertical.

17. The side bearing of claim 12 wherein the first coil spring and the second coil spring have preselected non-compressed height and load ratings and the elastomeric spring has a preselected non-compressed height such that, under empty railway car conditions, the cap will contact the elastomeric spring when the railway car reaches a desired limit of rock from the vertical.

18. The side bearing of claim 12 wherein the first coil spring and the second coil spring have preselected non-compressed heights and load ratings and the elastomeric spring has preselected non-compressed height such that the cap will engage the elastomer spring only when the first and second coil springs are compressed to within about one half inch of their maximum compression.

19. The side bearing of claim 12 wherein the cap top portion has a bottom surface, and a positioning protrusion extends from the cap top portion bottom surface.

20. The side bearing of claim 12 wherein the cap wall structure extends within the base receiving structure.

21. The side bearing of claim 19 wherein the cap wall structure includes a bottom surface, the base wall structure includes a stop surface, and the cap wall structure extension with the base receiving structure is limited by the cap wall structure bottom surface contacting the base wall structure stop surface.

22. The side bearing of claim 12, wherein the cap includes an inner stop surface, and the base wall structure includes a top edge, and the cap wall structure extrusion over the base wall structure is limited by the base wall structure top edge contacting the inner stop surface of the cap.

* * * * *